US006448706B1

(12) United States Patent
Kawamura et al.

(10) Patent No.: US 6,448,706 B1
(45) Date of Patent: Sep. 10, 2002

(54) INLINE TYPE COLOR PICTURE TUBE

(75) Inventors: Katsuyuki Kawamura; Yuichi Inoue; Hiroki Taga, all of Mobara (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/473,955

(22) Filed: Dec. 29, 1999

(51) Int. Cl.[7] ..... H01J 31/00

(52) U.S. Cl. ..... 313/477 R; 313/402; 313/403; 313/478

(58) Field of Search ..... 313/477 R, 461, 313/478, 403, 402, 408; 220/2.1 R, 2.1 A

(56) References Cited

U.S. PATENT DOCUMENTS

| | | | | |
|---|---|---|---|---|
| 5,925,977 A | * | 7/1999 | Sugawara et al. | 313/477 R |
| 6,031,345 A | | 2/2000 | Nakata | 313/440 |
| 6,114,803 A | * | 9/2000 | Hosotani | 313/461 |
| 6,236,151 B1 | * | 5/2001 | Murakami et al. | 313/402 |

FOREIGN PATENT DOCUMENTS

| | | |
|---|---|---|
| DE | 19623047 | 12/1996 |
| EP | 843333 | 5/1998 |
| EP | 905742 | 3/1999 |
| EP | 923107 | 6/1999 |
| EP | 933797 | 8/1999 |

OTHER PUBLICATIONS

Patent Abstracts of Japan vol. 008, No. 095, E–242 May 1984, & JP 59 014240, Hitachi Seisakusho KK Jan. 25, 1984.

Mitsuda K et al (Tokyo Shibaura Electric Co., Toshiba Electronic ENG, Mar. 31, 1999, abstract, Figure 2.

* cited by examiner

*Primary Examiner*—Vip Patel
*Assistant Examiner*—Mariceli Santiago
(74) *Attorney, Agent, or Firm*—Antonelli, Terry, Stout & Kraus, LLP

(57) ABSTRACT

A color picture tube has a panel which is substantially flat on its outer surface, while an inner surface of the panel is curved, and a shadow mask having a curvature that is greater than that of the curved plane on the inner panel surface. The panel is made of glass, such as a tint material, a ring-like magnet assembly (PCM) for convergence adjustment is provided outside of the neck, a first electromagnetic quadrupole coil is further attached to a portion outside of the neck for causing an electron beam spacing to change or vary in accordance with the deflection angle, and a second electromagnetic quadrupole coil is attached to a deflection yoke. The distance between adjacent ones of three cathodes of an electron gun is determined to be greater than or equal to 6.0 millimeters (mm).

46 Claims, 7 Drawing Sheets

INLINE TYPE COLOR PICTURE TUBE

BACKGROUND OF THE INVENTION

As demands for further enhancement of image definition on a display screen are becoming more strict along with a growing need to reduce external light reflectivity thereon for prevention of unwanted on-screen visualization of "ghost" images of exterior scenes, color picture tubes with a panel having a flat outer surface have been developed in recent years.

One prior known approach to achieving this is to let the panel have a certain curvature on its inner surface while making the panel's outer face flat. This methodology has the advantage of allowing a shadow mask to exhibit a curved plane, which in turn makes it possible to take full advantage of currently available shadow-mask manufacturing architectures. On the other hand, the prior known approach suffers from the need to specifically design the panel in such a way as to provide an excessively large curvature on the inner panel face as compared to that on the outer face thereof, which would result in an excessive increase in glass plate thickness at or near the periphery of the panel when compared to the glass thickness at the center thereof This disadvantageously creates a serious problem. For example, possible differences in brightness or luminance between certain locations, one of which is at the center of a phosphor film and the other of which is the periphery of the phosphor plane, along with influence or interference of the curved plane on the inner panel face, can deteriorate or degrade the flatness of the display screen as it appears to the users. Accordingly, in the event that the outer panel face is made flat, it seems desirable for the curvature of the inner panel face to be as small in value as possible.

On the other hand, the manufacturability increases when the shadow mask has a larger curvature. A traditionally proposed way of solving this is that the between-electron-beams distance S-size is designed so that it is made smaller at the periphery of the display screen than at the center thereof This technique has been disclosed, for example, in a report of the International Display Workshop (IDW) '98 at pp. 412–416. This document discloses a technique for reducing the net value of the S-size at the periphery by employing a couple of electromagnetic quadrupoles. Unfortunately, the advantage of this approach does not come without accompanying problems. For example, those images which are visually displayed on the screen have less contrast; additional panel-surface processing will be required inevitably; and, the influence of geomagnetism becomes greater due to the fact that the resulting distance between the inner panel face and its associative shadow mask, i.e. the q-size, remains greater at the periphery.

SUMMARY OF THE INVENTION

The object of the present invention is to provide a color picture tube including a panel section having an outer surface made substantially flat and which exhibits required contrast and geomagnetic margins or the like without requiring use of panel-surface processing even in cases where a press formed shadow mask is used. To attain this object, the present invention as disclosed herein uses tint or dark tint materials as a glass material for the panel, while at the same time specifically setting the difference between a glass plate thickness, Tc, at the center of such glass and the glass thickness, Td, at the periphery thereof, namely, a ratio Wd/Tc of the so-called "wedge amount" Wd to the value Tc, to be less than or equal to 0.8, or alternatively, by letting the absolute value of Wd be set at 12 millimeters (mm) or less. Further, letting the S-size at the cathodes of an electron gun be set at 6.0 mm or below makes it possible to suppress or minimize any possible influence or interference of the geomagnetism at the periphery of a display screen. While two pairs of electromagnetic quadrupole coils are used to render the net value of such S-size smaller at the screen periphery than in the center thereof, the first one of such electromagnetic quadrupole coils is provided so as to overlie the neck portion of the picture tube along with more than one ring-shaped purity/convergence magnet (PCM) operatively associated therewith.

BRIEF DESCRIPTION OF THE DRAWINGS

FIG. 5(*b*) is a sectional view on line A—A in FIG. 5(*a*), of the electromagnetic quadrupole coil of FIG. 4 in the case of using a pole piece.

DESCRIPTION OF THE PREFERRED EMBODIMENT

Figure 1:
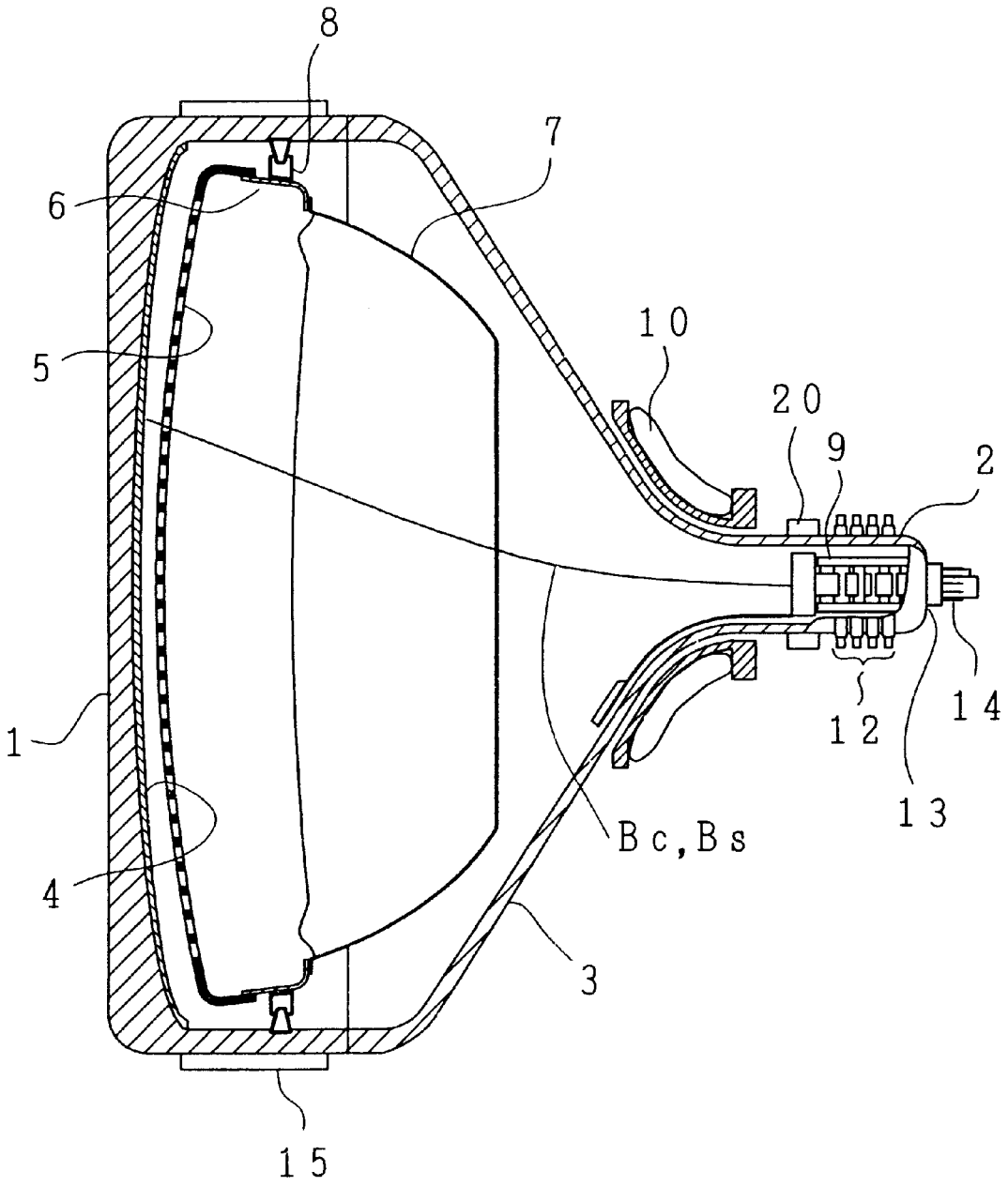
FIG. 1 is a longitudinal sectional view of a color picture tube in accordance with the present invention.

In FIG. 1, the cathode ray tube includes a panel portion 1; a neck portion 2; a funnel portion 3; a phosphor film 4; a shadow mask 5; a mask frame 6; a mask support mechanism 8; an inner magnetic shield 7; a deflection yoke 10; an electron gun 9; a purity and convergence correction magnet (PCM) 12; stem pins 13; a stem 14; a protection band 15; and an electromagnetic quadruple coil 20. Bc denotes a center electron beam; while Bs denotes a side electron beams. In the cathode ray tube shown in FIG. 1, an evacuated envelope is constructed of the panel portion 1, the neck portion 2 housing the electron gun, and the funnel portion 3 connecting the glass panel portion and the neck portion.

The shadow mask 5 is welded to the mask frame 6 and is suspended by the support mechanism 8 with support pins which are buried in the inner wall of the skirt portion of the panel portion 1, so that it is held at a predetermined spacing from the phosphor film 4 formed on the inner face of the panel portion.

The panel 1 has an outer surface that is flat or alternatively has an extremely large radius of curvature. Generally, the curved plane of such panel is obtained by calculating the drop-down amount from the panel center, represented by "Z," in a accordance with the equation:

$$Z=A1X^2+A2X^4+A3Y^2+A4X^2Y^2+A5X^4Y^2+A6Y^4+A7X^2Y^4+A8X^4Y^4,$$

with selection of those coefficients or parameters A1 through A8 in the equation. Some examples of the panel's curved plane, in case the present invention is applied to a 36V-type color picture tube (CPT), are shown in Tables 1 and 2 below.

TABLE 1

| Parameters A1–A8 of the outer panel surface: | | | |
|---|---|---|---|
| A1 | $0.1156035 \times 10^{-4}$ | A5 | $-0.1309278 \times 10^{19}$ |
| A2 | $0.1545012 \times 10^{-4}$ | A6 | $0.9600291 \times 10^{14}$ |
| A3 | $0.2125280 \times 10^{-4}$ | A7 | $-0.3875353 \times 10^{19}$ |
| A4 | $-0.2866930 \times 10^{-10}$ | A8 | $0.4856608 \times 10^{-25}$ |

TABLE 2

| Parameters A1–A8 of the inner panel surface: | | | |
|---|---|---|---|
| A1 | $0.3839236 \times 10^{-4}$ | A5 | $-0.5680002 \times 10^{-17}$ |
| A2 | $0.5662136 \times 10^{-13}$ | A6 | $0.3385039 \times 10^{-11}$ |
| A3 | $0.1499420 \times 10^{-3}$ | A7 | $-0.2802914 \times 10^{-16}$ |
| A4 | $-0.4172959 \times 10^{-9}$ | A8 | $0.6708166 \times 10^{-22}$ |

Figure 2:
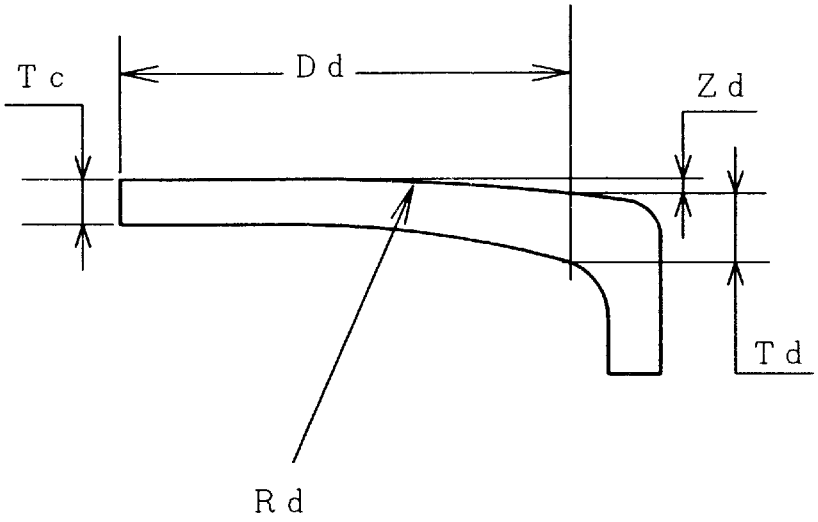
FIG. 2 is a detailed diagram of a panel.

In the panel discussed above, the radius of curvature is generally different in value depending upon the location. For evaluation of the flatness of such a panel, it is possible to use an equivalent radius of curvature based on the dropdown amount in a diagonal direction, as shown in FIG. 2. In this case, when letting a half of the effective diameter in such a diagonal direction be represented by "Dd" while the dropdown amount is indicated by "Zd", as shown in FIG. 2, the resultant equivalent radius of curvature "Rd" may be given as $Rd=(Dd^2+Zd^2)/(2Zd)$. Even where the radius of curvature stays at the same value, the influence upon the flatness becomes different depending on the screen size. Due to this, as representation methodology with the flatness of the panel face normalized, one method is available for representing the flatness in a way which follows:

for the outer surface, define Ro=42.5V+45.0 mm, for the inner surface, define Ri=40.0V+40.0 mm, then, use it as a reference (1R) to specify what times greater than this. Here, "V" is a value of the effective diagonal length of the panel as represented in inches. It has been well known that if the outer radius of curvature of the outer face is 10R, then the resultant plane is seen to be almost flat. If it is 36V, then a radius of curvature corresponding to 10R is 15,750 millimeters (mm). Additionally, if it is 20R, then the plane is seen to be almost perfectly flat. The radius of curvature in this case is 31,500 mm. The outer panel face referred to above substantially corresponds to this.

Although the outer panel surface is flat, it is required to form a curved plane for the shadow mask 5. Since the curved plane of such shadow mask is typically set at certain values close or approximate to the panel's curved inner plane, it remains necessary to let the inner panel face have a curvature that is extremely larger than that of the outer face. In this case, a brightness deviation can take place between the center and peripheral portions of the panel due to the fact that the glass plate thickness Tc at the panel center is different from the glass plate thickness Td at the periphery in the tube axis direction of a Brawn tube (such difference between the values Td and Tc is called the wedge amount Wd). To avoid this, clear materials have been traditionally employed as the glass material of the panel. However, because such clear glass materials inherently provide less contrast, it has been necessary to perform surface coating processings for reduction of the optical transmittance thereof. The present invention is specifically directed toward setting a ratio of the wedge amount (Wd) to the screen center glass thickness (Tc) i.e. Wd/Tc so that this ratio is less than or equal to 0.8, thereby enabling use of either tint materials or dark tint materials. Even in this case also, it is recommended that the absolute value of such wedge amount be less than or equal to 12 mm; preferably, 10 mm or less. With the 36V panel of the illustrative embodiment, the central glass thickness 19-mm wedge is 9.21 mm. Use of tint or dark tint materials will advantageously avoid the need to perform additional surface processings for increasing the contrast. Table 3 presented below demonstrates a relation of glass materials versus optical transmittance values in case the glass plate thickness is set at 10.16 mm.

TABLE 3

Relation of glass material vs. transmittance.

| Material | Transmittance (%) |
|---|---|
| Clear | 86.0 |
| Semi-Clear | 80.0 |
| Tint | 57.0 |
| Dark Tint | 46.0 |

In this case, in order to further reduce the difference between the center and the periphery of the panel, the shadow mask is made variable in pitch to provide an increase of what is called the "purity" margin at the periphery, to thereby increase the resultant electron beam transmittance of the shadow mask, which in turn makes it possible to lower the center-to-periphery brightness ratio. Letting the shadow mask be variable in pitch also achieves another advantage in that it allows the shadow mask to exhibit further enhanced curvature at the periphery thereof. In the embodiment of the present invention as disclosed herein, an aperture pitch of the shadow mask in a horizontal direction of the center portion (Pc) is designed to measure 0.9 mm, whereas an aperture pitch of the shadow mask at the diagonal effective diameter edge portion (Pd) is set at 1.26 mm, which results in achievement of a mask pitch grading of 40%. With such value settings, it becomes possible to improve by 15% the mask transmittance at the periphery of an electron beam. While an increase in shadow mask pitch results in a decrease in resolution of on-screen images at the periphery, it is possible to suppress any increase in shadow mask pitch down to approximately 30% ($Pd/Pc \geqq 1.3$) by letting the value of Wd/Tc be set at 0.7 or below. Note that letting Wd/Tc be 0.5 or less makes it possible to suppress or further reduce such increase in shadow mask pitch down to approximately 20% ($Pd/Pc \geqq 1.2$).

Figure 3:
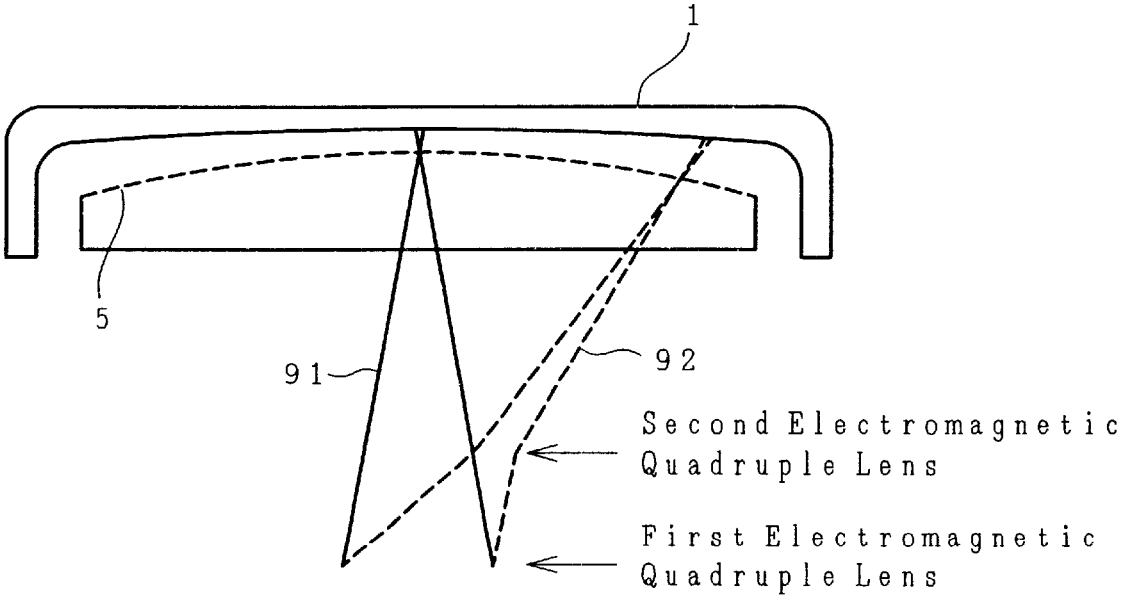
FIG. 3 is a diagram showing a scheme for permitting an S-size to change or vary effectively.

In the event that the wedge is made smaller, it becomes difficult to permit the curvature of inner panel face to stay extremely large with respect to the outer panel face. One example is that, in the case of the panel in accordance with the embodiment of this invention, the equivalent radius of curvature in diagonal directions measures 36,510 mm on the outer surface, whereas the same is 8,480 mm on the inner face. It is difficult to manufacture the intended shadow mask using a press-machining scheme while causing it to have the same radius of curvature as that on the inner panel face. As discussed previously, letting the shadow mask be variable in pitch must result in an increase in shadow mask curvature that is advantageous but not sufficient. In this embodiment, as shown in FIG. 3, the distance between the shadow mask and the inner panel face, namely, the "q" size, is enlarged by effectively reducing the "S" size at the periphery of the display screen. As a result of this, it becomes possible to allow the shadow mask to have a larger curvature.

Unfortunately, an increase in the q-size would normally result in the increases in influence of geomagnetism upon the electron beams concerned, which leads to degradation of the color purity of on-screen images. This geomagnetic influence or interference is serious particularly at the periphery of a display screen. The instant invention is designed to eliminate or at least greatly suppress any possible decreases in purity at the screen periphery by enlarging in advance the S-size at the cathodes of the electron gun, with the q-size being made smaller as a whole. According to the teachings of this invention, the S-size on a cathode plane is set at 6.0 mm or greater. In the illustrative embodiment it is 6.3 mm. With such a value, it becomes possible to reduce the q-size by about 15% as compared to the case of S=5.5 mm, as has been typically used in the prior art. An upper limit of the S-size increment is determinable by the outer diameter of the neck 2 also. In this embodiment the outer diameter of the neck 2 is 29.1 mm. Additionally, letting S=6.6 mm enables partial use of prior known electron gun technologies.

One principal feature of the present invention is that the use of two electromagnetic quadrupole lenses permits simultaneous accomplishment of both a technique for decreasing the effective S-size at the screen periphery and use of a ring-shaped magnet (PCM) for adjusting the purity and convergence. Practically, use is made of two separate electromagnetic quadrupole lenses disposed in the tube axis direction to reduce the S-size at the periphery of a display screen. Although currently available purity/convergence adjustment methodology may include a variety of kinds of approaches including, but not limited to, a method for assembling or mounting a magnet within the neck of a Brawn tube, and a method having the steps of forming a coil outside of the neck and then performing adjustment by using a magnetic field generated by a flow of current, a standard approach in most cases is to employ a method of adjustment with bipolar and quadrupole plus hexapole ring-like magnets installed outside of the neck. One example of this approach has been disclosed in U.S. Pat. No. 4,570,140, which is hereby incorporated by reference. While this method as taught by U.S. Pat. No. '140 offers a technical advantage, it calls for use of a certain space on the neck. In the case of using a couple of electromagnetic quadrupole lenses, it is required that the first one of such electromagnetic quadrupole lenses be formed on or above the neck of a Brawn tube, which results in a need to reserve the required above-the-neck space, which poses problems.

Figure 4:
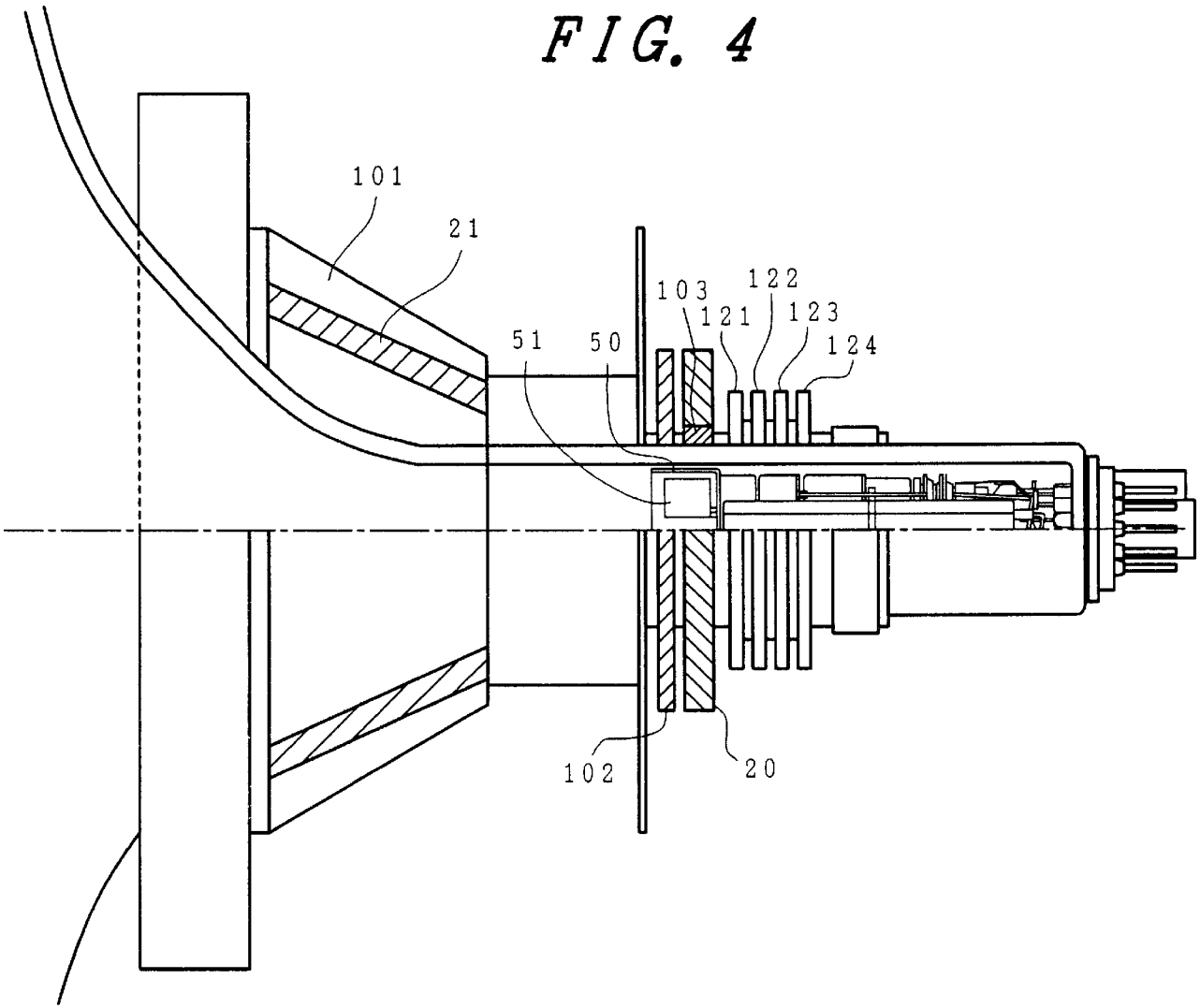
FIG. 4 is a longitudinal view partly in section of a first electromagnetic quadrupole coil module.

A first layout according to the present invention is shown in FIG. 4. In this drawing, reference numerals 121, 122, 123, and 124 designate respective pairs of ring magnets, which are of dipole, quadrupole, hexapole, and quadrupole configuration, respectively. The provision of two quadrupole pairs is for correction of so-called arc-shaped misconvergence. One pair (122 or 124) of these quadrupole pairs may be placed at a location in close proximity to a CY coil 102. Numeral 101 denotes the core of a deflection yoke, and 102 denotes a CY coil for frame correction. A second electromagnetic quadrupole coil 21 is wound around the deflection yoke core 101. A shield cup 50 is disposed at the distal end of an electron gun, and a pole piece 51 is assembled within the shield cup. This pole piece is made of magnetic materials. A first electromagnetic quadrupole coil 20 is mounted between the PCM magnet assembly and the CY coil 102 and is installed at a substantially corresponding portion of the pole piece. Especially in the case of large-screen color Brawn tubes for use in television (TV) sets, a velocity modulation coil (VM coil) 103 is employable for enhancement of the on-screen contrast. In the illustrated embodiment, this VM coil 103 is installed between the first electromagnetic quadrupole coil 20 and the neck 2. On the other hand, the VM coil 103 may alternatively be installed between the electromagnetic quadrupole coil 20 and the neck 2.

Figure 5A:
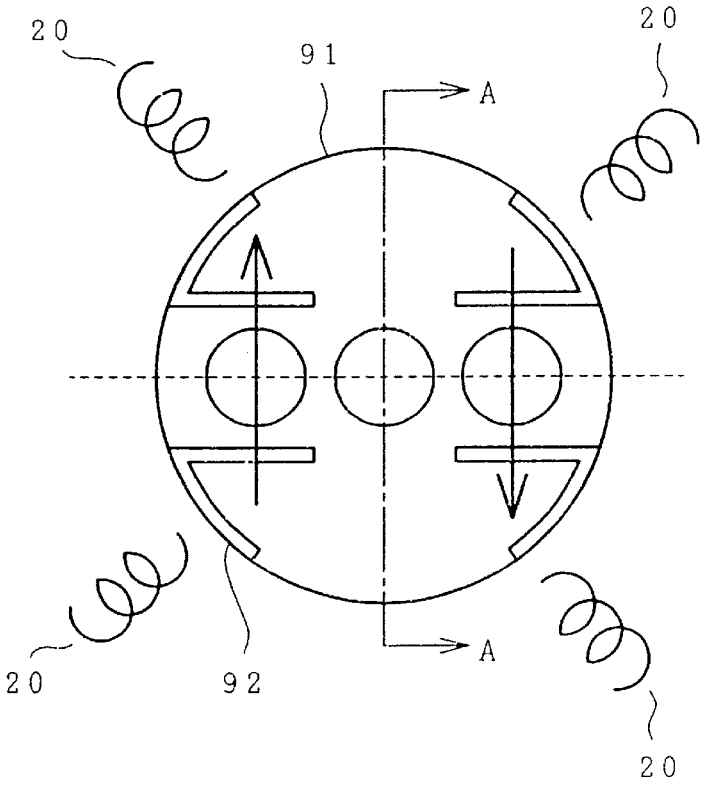
FIG. 5(*a*) is a top view.
Figure 5B:
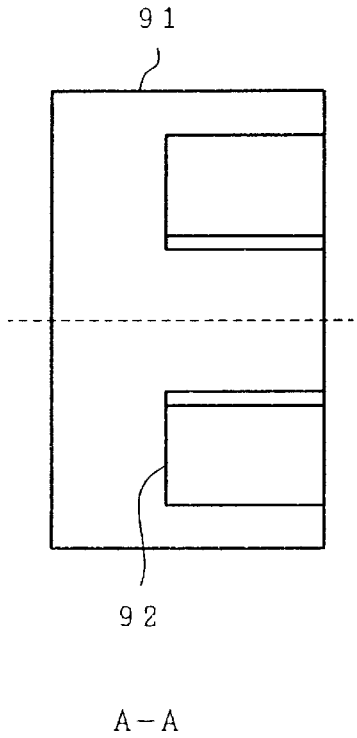

Locating the first electromagnetic quadrupole 20 at a specified position far from the main lens of an electron gun makes it possible to suppress or reduce the influence of this coil on the focus. In addition, use of the pole piece enables successful utilization of magnetic fluxes of the electromagnetic quadrupole. Whereas the deflection yoke's vertical deflection coil has a length in the tube axis direction that is substantially the same as that of the core, its horizontal deflection coil is elongated so that it extends up to the front side and rear side of the coil. FIG. 5(*a*) shows a state in which the pole piece has been assembled to the shield cup. Arrows depicted in FIG. 5(*a*) are used to indicate exemplary directions of magnetic fluxes due to the electromagnetic quadrupole. The magnetic fluxes are generated from the electromagnetic quadrupole coil 20 and pass through the pole piece 92 to act on electron beams on both sides. Although in FIG. 5(*a*) four electromagnetic quadrupole 10 coils 20 are illustrated for purposes of explanation of the principle of this invention, the four coils may be provided as are continuous coil.

Figure 6:
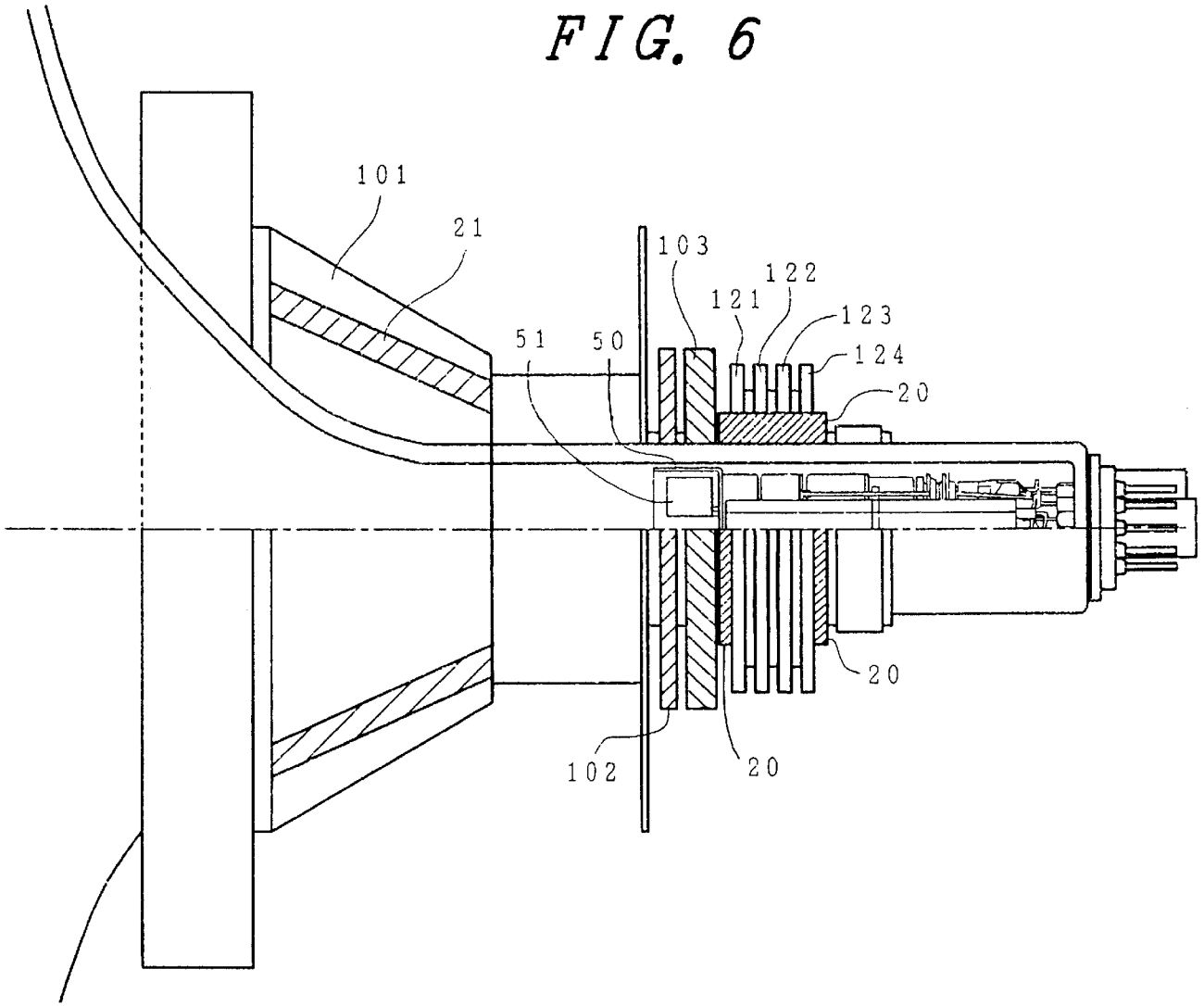
FIG. 6 is a longitudinal view partly in section of the first electromagnetic quadrupole coil, unit.

A second layout in accordance with the present invention is shown in FIG. 6. In this case the ring magnets (PCMs) 121–124 are designed to have an increased inner diameter, while the first electromagnetic quadrupole coil 20 is disposed between the neck glass and the ring magnets. This electromagnetic quadrupole coil 20 may be made of any materials as long as they are capable of well controlling the electron beam spacing "S" as a function of the deflection angles involved. In this case it will not always be required to provide the pole piece within the shield cup. In this embodiment, the VM coil 103 was installed between the electromagnetic quadrupole 20 and the CY coil 102. Note here that, although both the first layout example and the second example of this invention are arranged so that the deflection yoke is set forth in such a way as to be integral with its associative PCM and the first electromagnetic quadrupole coil, they may be arranged as separate or discrete members when the need arises to do so.

Figure 7:
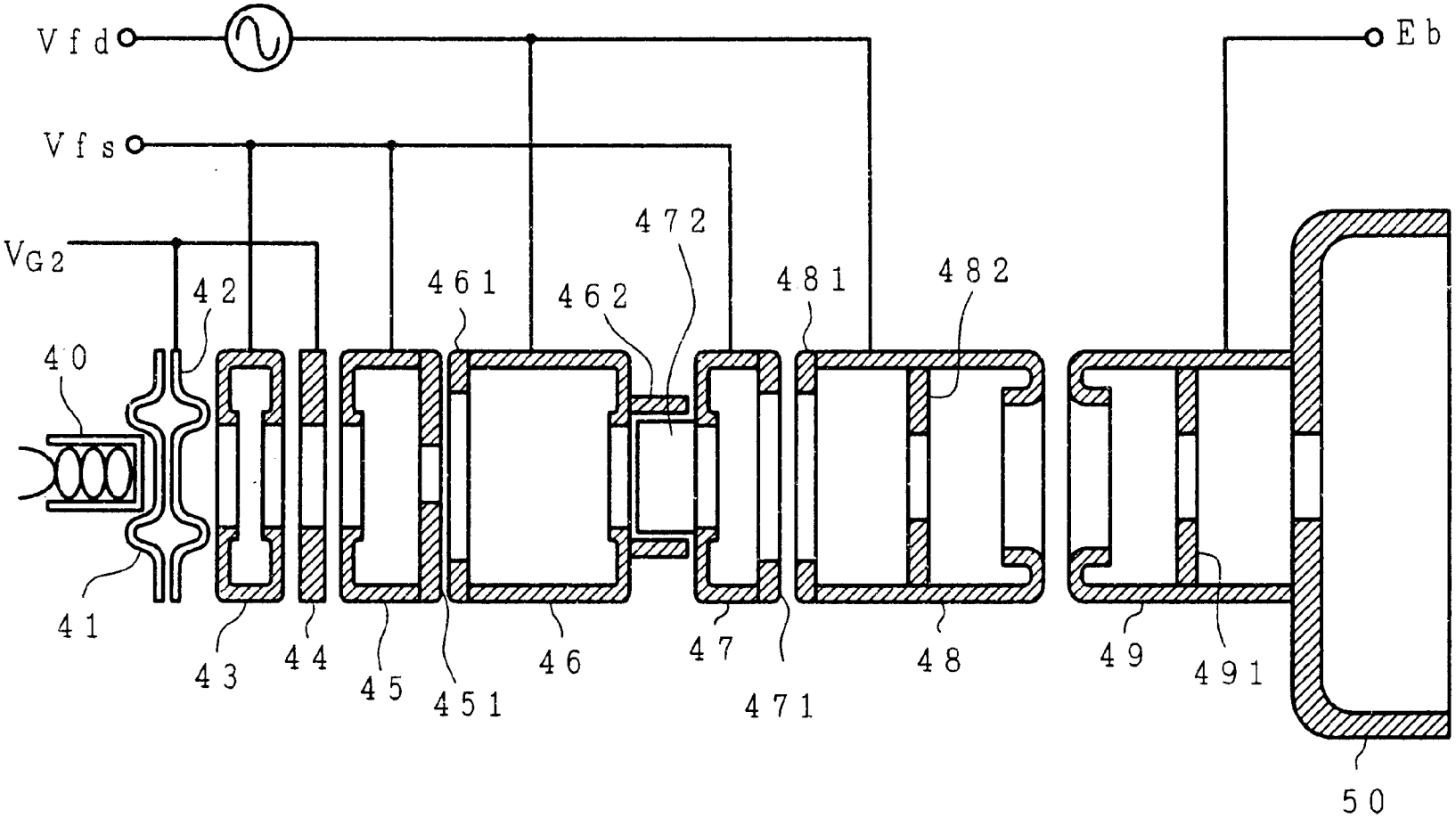
FIG. 7 is a longitudinal sectional view of an electron gun used in the present invention.

FIG. 7 is an example of an electron gun used in the present invention. FIG. 7 is a diagram showing a longitudinal cross-sectional view of the electron gun. In FIG. 7, numeral 40 designates a set of three cathodes disposed in a direction at right angles to the surface of the drawing with an interval of 6.3 mm between adjacent ones of them. Numeral 41 denotes a control electrode G1, and 42 denotes an acceleration electrode G2. Electrodes 43, 44, 45 are provided to constitute a pre-focus-stage lens structure. A static focusing voltage Vfs is applied to the electrodes 43 and 45, while the same voltage as the acceleration electrode is applied to the electrode 44. These three electrodes form a so-called UPF lens. Although any one of the electrodes 46, 47, 48 is used as a focusing electrode, they are divided into separate parts in order to form a lens having dynamic characteristics.

A dynamic focusing voltage that increases in potential with an increase in deflection angle is applied to the electrode 46 and the electrode 48, whereas a static focus voltage is applied to the electrode 47. An opening or hole that is formed in an electrode 451 is wider than it is tall; while, a hole formed in an electrode 461 is taller than it is wide. As a result, the intended static electromagnetic quadrupole is formed along with a dynamic voltage. A horizontal plate-like electrode 462 and a vertical plate electrode 472 make up another electromagnetic quadrupole. A hole that is taller than it is wide is formed in each of electrodes 471, 481, whereby the lens intensity varies with a change in dynamic voltage applied thereto and, simultaneously, a lens is formed which functions to shape the electron beam to be greater in longitudinal dimension.

An anode voltage that is the maximum voltage among those voltages concerned is applied to an anode electrode 49, whereby a main lens is formed between it and the electrode 48. This main lens is such that its lens intensity tends to decrease with an increase in dynamic voltage. A focus plate electrode 482 is installed within the focus electrode 48 and has a longitudinally longer hole or aperture. A plate-like electrode 491 is installed within the anode electrode and has a longitudinally longer hole or aperture.

Figure 8:
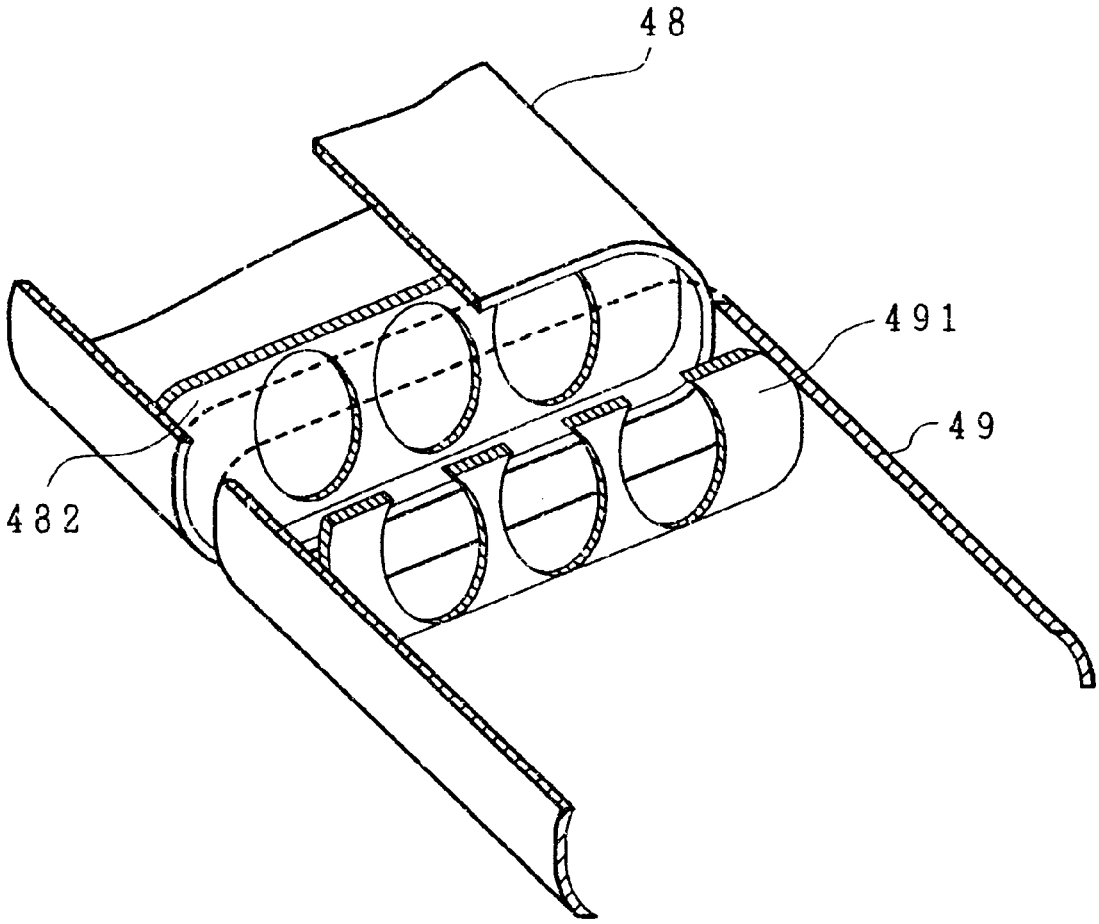
FIG. 8 is a perspective view which shows one example of a main lens.

FIG. 8 is a detailed diagram of the main lens unit. This is one of those electron guns of the large lens diameter type. Although the internal electrodes 482, 491 shown herein are designed so that each has three longitudinally longer holes, this may be modified if necessary to provide only one electron-beam passing hole at the center thereof with specified portions on the opposite sides being cut away.

In cases where the phosphor plane is made flat, focusing can be degraded especially at its peripheral portions; fortunately, such focusing degradation at the periphery may be suppressed or reduced by use of dynamic focusing techniques. In addition, the use of the large-lens type electron gun as set forth in this embodiment makes it possible to reduce or minimize any possible focus degradation in the event that a high current flows therein.

What is claimed is:

1. An inline type color picture tube including an evacuated envelope housing having a panel with a phosphor film formed on an inner surface thereof, a neck portion having there-in an electron gun, and a funnel portion connecting the panel and the neck portion together; a shadow mask press formed to oppose the inner surface of said panel; a defection yoke attached to a portion at or near said neck portion and a connecting portion of said funnel portion and having a horizontal deflection coil, a vertical deflection coil and a core; and a ring-like magnet attached to the outer periphery of said neck portion for adjustment of purity and convergence, characterized in that an equivalent radius of curvature, Rd, as measured in millimeters (mm) in a diagonal direction of an outer surface of said panel is determined to satisfy a relation of $$Rd(\text{mm}) \geqq 10R(\text{mm})$$

where R is given as $$R = 42.4V + 45.0$$

where V is a value of a diagonal effective diameter in units of inches;

said panel is made of a tint glass material;

when letting a central glass thickness of said panel be represented by "Tc", and a glass thickness thereof in a tube direction at a diagonal effective diameter edge portion be indicated by "Td" and Wd=Td−Tc, then Wd/Tc≦0.8 is obtained;

said electron gun includes an array of cathodes aligned in an inline direction at a distance, Sk, between adjacent ones of said cathodes, said distance Sk being greater than or equal to 6.0 mm; and a first coil is attached to the outside of said neck portion for forming an electromagnetic quadrupole for use in causing a change in electron beam spacing as a function of deflection angle, whereas a second coil is attached to said deflection yoke for forming an electromagnetic quadrupole to change the electron beam spacing as a function of the deflection angle.

2. The inline type color picture tube according to claim 1, characterized in that said shadow mask has an aperture pitch in a horizontal direction and that when the aperture pitch is Pc at the center and is Pd at the diagonal effective diameter edge portions, a ratio Pd/Pc is greater than or equal to 1.2.

3. The inline type color picture tube according to claim 2, characterized in that Pd/Pc≧1.3.

4. The inline type color picture tube according to claim 1, characterized in that said cathode distance Sk is substantially equal to 6.3 mm.

5. The inline type color picture tube according to claim 1, characterized in that said cathode distance Sk is substantially equal to 6.6 mm.

6. The inline type color picture tube according to claim 1, characterized in that the values Wd and Tc are determined to satisfy Wd/Tc≦0.7.

7. The inline type color picture tube according to claim 1, characterized in that the values Wd and Tc are determined to satisfy Wd/Tc≦0.5.

8. The inline type color picture tube according to claim 1, characterized in that said first coil is formed between said ring-like magnet and said neck portion.

9. The inline type color picture tube according to claim 1, characterized in that said first coil is formed between said ring-like magnet and the core of said deflection yoke.

10. The inline type color picture tube according to claim 1, characterized in that a CY coil for coma correction is formed on a cathode side of said electron gun of the horizontal deflection coil of said deflection yoke and that said first coil is formed between said CY coil and said ring-like magnet.

11. The inline type color picture tube according to claim 1, characterized in that said first coil is formed in close proximity to the phosphor film relative to a main lens of said electron gun.

12. The inline type color picture tube according to claim 1, characterized in that said electron gun has a pole piece used to form the electromagnetic quadrupole and that said first coil is formed adjacent to said pole piece.

13. The inline type color picture tube according to claim 12, characterized in that said pole piece is attached to a shield cup of said electron gun.

14. An inline type color picture tube including an evacuated envelope housing having a panel with a phosphor film formed on an inner surface thereof; a neck portion having therein an electron gun, and a funnel portion connecting the panel and the neck portion together; a shadow mask press formed to oppose the inner surface of said panel; a defection yoke attached to a portion at or near said neck portion and a connecting portion of said funnel portion and having a horizontal deflection coil, a vertical deflection coil and a core; and a ring-like magnet attached to the outer periphery of said neck portion for adjustment of purity and convergence, characterized in that an equivalent radius of curvature, Rd, as measured in millimeters (mm) in a diagonal direction of an outer surface of said panel is determined to satisfy a relation of $$Rd(\text{mm}) \geqq 10R(\text{mm})$$

where R is given as $$R = 42.4V + 45.0$$

where V is a value of a diagonal effective diameter in units of inches;

said panel is made of a tint glass material;

when letting a central glass thickness of said panel be represented by "Tc", a glass thickness thereof in a tube direction at a diagonal effective diameter edge portion be indicated by "Td" and Td−Tc=Wd, then Wd is 12 mm or less;

said electron gun includes an array of cathodes aligned in an inline direction at a distance, Sk, between adjacent ones of said cathodes, said distance Sk being greater than or equal to 6.0 mm; and a first coil is attached to the outside of said neck portion for forming an electromagnetic quadrupole for use in causing a change in electron beam spacing as a function of a deflection angle, whereas a second coil is attached to said deflection yoke for forming an electromagnetic quadrupole to change the electron beam spacing as a function of the deflection angle.

15. The inline type color picture tube according to claim 14, characterized in that said shadow mask has an aperture pitch in a horizontal direction and that when the aperture pitch is Pc at the center and is Pd at the diagonal effective diameter edge portions, a ratio Pd/Pc is greater than or equal to 1.2.

16. The inline type color picture tube according to claim 15, characterized in that Pd/Pc≧1.3.

17. The inline type color picture tube according to claim 14, characterized in that said cathode distance Sk is substantially equal to 6.3 mm.

18. The inline type color picture tube according to claim 14, characterized in that said cathode distance Sk is substantially equal to 6.6 mm.

19. The inline type color picture tube according to claim 14, characterized in that the value Wd is less than or equal to 10 mm.

20. The inline type color picture tube according to claim 14, characterized in that said first coil is formed between said ring-like magnet and said neck portion.

21. The inline type color picture tube according to claim 14, characterized in that said first coil is formed between said ring-like magnet and the core of said deflection yoke.

22. The inline type color picture tube according to claim 14, characterized in that a CY coil for coma correction is formed on a cathode side of said electron gun of the horizontal deflection coil of said deflection yoke and that said first coil is formed between said CY coil and said ring-like magnet.

23. The inline type color picture tube according to claim 14, characterized in that said first coil is formed in close proximity to the phosphor film relative to said electron gun.

24. The inline type color picture tube according to claim 14, characterized in that said electron gun has a pole piece used to form the electromagnetic quadrupole and that said first coil is formed adjacent to said pole piece.

25. The inline type color picture tube according to claim 24, characterized in that said pole piece is attached to a shield cup of said electron gun.

26. An inline type color picture tube including an evacuated envelope housing having a panel with a phosphor film formed on an inner surface thereof; a neck portion having therein an electron gun, and a funnel portion connecting the panel and the neck portion together; a shadow mask press formed to oppose the inner surface of said panel; a defection yoke attached to a portion at or near said neck portion and a connecting portion of said funnel portion and having a horizontal deflection coil, a vertical deflection coil and a core; and a ring-like magnet attached to the outer periphery of said neck portion for adjustment of purity and convergence, characterized in that an equivalent radius of curvature, Rd, as measured in millimeters (mm) in a diagonal direction of an outer surface of said panel is determined to satisfy a relation of $$Rd(\text{mm}) \geqq 10R(\text{mm})$$

where R is given as $$R = 42.4V + 45.0$$

where V is a value of a diagonal effective diameter in units of inches;

said panel is made of a dark tint glass material;

when letting a central glass thickness of said panel be represented by "Tc" and a glass thickness thereof in a tube direction at a diagonal effective diameter edge portion be indicated by "Td," then Wd/Tc≦0.7 is obtained where Wd=Td−Tc;

said electron gun includes an array of cathodes aligned in an inline direction at a distance, Sk, between adjacent ones of said cathodes, said distance Sk being greater than or equal to 6.0 mm; and a first coil is attached to the outside of said neck portion for forming an electromagnetic quadrupole for use in causing a change in electron beam spacing as a function of a deflection angle, whereas a second coil is attached to said deflection yoke for forming an electromagnetic quadrupole to change the electron beam spacing as a function of the deflection angle.

27. The inline type color picture tube according to claim 26, characterized in that said shadow mask has an aperture pitch in a horizontal direction and that when the aperture pitch is Pc at the center and is Pd at the diagonal effective diameter edge portions, a ratio Pd/Pc is greater than or equal to 1.2.

28. The inline type color picture tube according to claim 26, characterized in that said cathode distance Sk is substantially equal to 6.3 mm.

29. The inline type color picture tube according to claim 26, characterized in that said cathode distance Sk is substantially equal to 6.6 mm.

30. The inline type color picture tube according to claim 26, characterized in that the values Wd and Tc are determined to satisfy Wd/Tc≦0.5.

31. The inline type color picture tube according to claim 26, characterized in that said first coil is formed between said ring-like magnet and said neck portion.

32. The inline type color picture tube according to claim 26, characterized in that said first coil is formed between said ring-like magnet and the core of said deflection yoke.

33. The inline type color picture tube according to claim 26, characterized in that a CY coil for coma correction is formed on a cathode side of said electron gun of the horizontal deflection coil of said deflection yoke and that said first coil is formed between said CY coil and said ring-like magnet.

34. The inline type color picture tube according to claim 26, characterized in that said first coil is formed in close proximity to the phosphor film relative to a main lens of said electron gun.

35. The inline type color picture tube according to claim 26, characterized in that said electron gun has a pole piece used to form the electromagnetic quadrupole and that said first coil is formed adjacent to said pole piece.

36. The inline type color picture tube according to claim 35, characterized in that said pole piece is attached to a shield cup of said electron gun.

37. An inline type color picture tube including an evacuated envelope housing having a panel with a phosphor film formed on an inner surface thereof; a neck portion having therein an electron gun, and a funnel portion connecting the panel and the neck portion together; a shadow mask press formed to oppose the inner surface of said panel; a defection yoke attached to a portion at or near said neck portion and a connecting portion of said funnel portion and having a horizontal deflection coil, a vertical deflection coil and a core; and a ring-like magnet attached to the outer periphery of said neck portion for adjustment of purity and convergence, characterized in that an equivalent radius of curvature, Rd, as measured in millimeters (mm) in a diagonal direction of an outer surface of said panel is determined to satisfy a relation of $$Rd(\text{mm}) \geqq 10R(\text{mm})$$

where R is given as $$R = 42.4V + 45.0$$

where V is a value of a diagonal effective diameter in units of inches;

said panel is made of a dark tint glass material;

when letting a central glass thickness of said panel be represented by "Tc" and a glass thickness thereof in a tube direction at a diagonal effective diameter edge portion be indicated by "Td," then Wd is less than or equal to 10 mm where Wd=Td−Tc;

said electron gun includes an array of cathodes aligned in an inline direction at a distance, Sk, between adjacent ones of said cathodes, said distance Sk being greater than or equal to 6.0 mm; and a first coil is attached to the outside of said neck portion for forming an electromagnetic quadrupole for use in causing a change in electron beam spacing as a function of a deflection angle, whereas a second coil is attached to said deflection yoke for forming an electromagnetic quadrupole to change the electron beam spacing as a function of the deflection angle.

38. The inline type color picture tube according to claim 37, characterized in that said shadow mask has an aperture pitch in a horizontal direction and that when the aperture pitch is Pc at the center and is Pd at the diagonal effective diameter edge portions, a ratio Pd/Pc is greater than or equal to 1.2.

39. The inline type color picture tube according to claim 37, characterized in that said cathode distance Sk is substantially equal to 6.3 mm.

40. The inline type color picture tube according to claim 37, characterized in that said cathode distance Sk is substantially equal to 6.6 mm.

41. The inline type color picture tube according to claim 37, characterized in that said first coil is formed between said ring-like magnet and said neck portion.

42. The inline type color picture tube according to claim 37, characterized in that said first coil is formed between said ring-like magnet and the core of said deflection yoke.

43. The inline type color picture tube according to claim 37, characterized in that a CY coil for coma correction is formed on a cathode side of said electron gun of the horizontal deflection coil of said deflection yoke and that said first coil is formed between said CY coil and said ring-like magnet.

44. The inline type color picture tube according to claim 37, characterized in that said first coil is formed in close proximity to the phosphor film relative to the main lens of said electron gun.

45. The inline type color picture tube according to claim 37, characterized in that said electron gun has a pole piece used to form the electromagnetic quadrupole and that said first coil is formed adjacent to said pole piece.

46. The inline type color picture tube according to claim 45, characterized in that said pole piece is attached to a shield cup of said electron gun.

* * * * *